United States Patent [19]

Ishigaki et al.

[11] Patent Number: 4,790,009

[45] Date of Patent: Dec. 6, 1988

[54] SCRAMBLER SYSTEM

[75] Inventors: Yukinobu Ishigaki, Machida; Katsuhiro Onuki; Fumio Kawabata, both of Tokyo, all of Japan

[73] Assignee: Victor Company of Japan, Ltd., Japan

[21] Appl. No.: 791,786

[22] Filed: Oct. 28, 1985

[30] Foreign Application Priority Data

Oct. 29, 1984 [JP] Japan ..... 59-227241
Oct. 29, 1984 [JP] Japan ..... 59-227242

[51] Int. Cl.[4] ..... H04K 1/02
[52] U.S. Cl. ..... 380/9; 380/39
[58] Field of Search ..... 455/29; 179/1.5 S, 1.5 FS; 380/21, 28, 43, 44, 48, 49; 331/1 R, 18, 14, 17, 25

[56] References Cited

U.S. PATENT DOCUMENTS

| | | | |
|---|---|---|---|
| 3,696,207 | 10/1972 | Lundin et al. | 380/48 |
| 3,821,659 | 6/1974 | Ludwig | 331/1 R |
| 3,824,468 | 7/1974 | Zegers et al. | 455/29 |
| 3,838,342 | 9/1974 | Bjorkman | 455/29 |
| 3,942,115 | 3/1976 | Wolejsza, Jr. . | |
| 4,058,677 | 11/1977 | Maitland et al. | 179/1.5 S |
| 4,133,977 | 1/1979 | McGuire et al. | 179/1.5 S |
| 4,206,462 | 6/1980 | Rabow et al. | 455/29 |
| 4,231,113 | 10/1980 | Blasbalg | 455/29 |
| 4,276,652 | 6/1981 | McCalmont et al. | 179/1.5 FS |
| 4,278,840 | 7/1981 | Morgan et al. | 179/1.5 S |
| 4,351,064 | 9/1982 | Ewanus | 455/29 |
| 4,447,792 | 5/1984 | Wynn | 331/18 |
| 4,517,531 | 5/1985 | Tan et al. | 331/17 |
| 4,581,765 | 4/1986 | Stec | 455/29 |

*Primary Examiner*—Salvatore Cangialosi
*Assistant Examiner*—Bernarr Earl Gregory
*Attorney, Agent, or Firm*—Andrus, Sceales, Starke & Sawall

[57] ABSTRACT

A scrambler system comprises in a transmitter part thereof as oscillator circuit for generating a local oscillation signal, a frequency dividing circuit for obtaining a frequency divided signal by frequency-dividing the local oscillation signal by 1/N, a triangular wave signal generating circuit for converting the frequency divided signal into a triangular wave signal and for controlling the oscillation frequency of the oscillator circuit by the triangular wave signal, a multiplying circuit for obtaining a frequency converted audio signal by multiplying the local oscillation signal with an input audio signal which is to be scrambled, a pilot signal generating circuit for generating from the frequency divided signal a pilot signal having a single frequency, and an adding circuit for obtaining a scrambled signal for transmission by adding the pilot signal and the frequency converted audio signal. A key is used for de-scrambling the scrambled signal in a receiver part of the scrambler system.

21 Claims, 4 Drawing Sheets

(A)
LEVEL
S1
f1
f2
FREQ
(B)
LEVEL
S2
f3
FREQ
(C)
LEVEL
Sd1
Su1
f5
f4
f3
f6
f7
FREQ
(D)
LEVEL
S6
Sd1
f3/N
f5
f4
FREQ
(E)
LEVEL
f1
f2
FREQ
(F)
LEVEL
S1
f1
f2
FREQ (A)
S2(S2a)
(B)
S4(S4a,S4b)
(C)
S5(S5a)
(D)
S6
TIME

SCRAMBLER SYSTEM

BACKGROUND OF THE INVENTION

The present invention generally relates to scrambler systems, and more particularly to a scrambler system which is suited for application in radio communication when transmitting an audio signal.

Recently, radio communication systems are applied to general telecommunication. Cordless telephone systems are already reduced to practice, and there is a first telephone system wherein a main telephone set (connecting apparatus of the cordless telephone) which is connected to a telephone line and a cordless sub telephone set (hand set of the cordless telephone) are connected by radio. There is also a second telephone system wherein a car telephone set is coupled to a telephone line by radio via a relay station. In the case of the first telephone system, the radio transmission and reception between the main telephone set and the sub telephone set can be performed within a range of 200 meters, for example, and for this reason, it is possible to intercept the radio communication by another sub telephone set or a high fidelity radio set within the 200 meter range. On the other hand, in the case of the second telephone system, the radio transmission and reception between the car telephone set and the relay station can be intercepted by a high fidelity radio set. Hence, there are scrambler systems for scrambling the audio signal before the radio transmission so that the content of the audio signal will be unintelligible to a person who makes the radio interception. According to the scrambler system, the audio signal is scrambled in accordance with a predetermined rule before the radio transmission. Hence, the content of the radio transmission will be unintelligible unless the transmitted signal is de-scrambled in accordance with the rule (key) which was used to scramble the audio signal before the radio transmission. In other words, the audio signal which is transmitted by use of such a scrambler system cannot be de-scrambled back into the original audio signal unless the key of the scrambler system is known, and the scrambler system is effective in preventing radio poaching by the radio interception.

As examples of the conventional scrambler system, there are scrambler systems which process the audio signal on the frequency axis before the radio transmission. According to a first scrambler system, a transmitter frequency-converts the audio signal before the radio transmission, and a receiver frequency-converts the received frequency converted audio signal back into the original audio signal. The circuit construction of the first scrambler system is simple, however, there is a disadvantage in that it is easy to see through the first scrambler system by guessing the frequency of the frequency converting signal. According to a second scrambler system, a transmitter divides the frequency band of the audio signal into a plurality of frequency bands and transmits signals in the divided frequency bands in a predetermined sequence, and a receiver restores the received signals in the divided frequency bands back into the original sequence so as to obtain the original audio signal. It is difficult to see through the second scrambler system, however, there is a disadvantage in that the circuit construction is complex.

On the other hand, as other examples of the conventional scrambler system, there are scrambler systems which process the audio signal on the time base before the radio transmission. According to a third scrambler system, a transmitter compresses and expands arbitrary parts of the audio signal on the time base before the radio transmission, and a receiver performs expansion and compression complementary to those performed in the transmitter so as to obtain the original audio signal. It is difficult to see through the third scrambler system, however, there are disadvantages in that the circuit construction is complex and the sound quality becomes deteriorated when the expansion and compression are performed in the receiver so as to obtain the original audio signal. According to a fourth scrambler system, a transmitter samples the audio signal at a predetermined sampling frequency and transmits the sampled data in a predetermined sequence, and a receiver restores the received sampled data back into the original sequence so as to obtain the original audio signal. It is difficult to see through the fourth scrambler system, but there is a disadvantage in that the circuit construction is complex. In addition, there is another disadvantage in that the sound quality becomes deteriorated when restoring the received sampled data back into the original sequence and obtaining the original audio signal.

As still another example of the conventional scrambler system, there is a fifth scrambler system which processes the audio signal digitally before the radio transmission. According to the fifth scrambler system, a transmitter converts the audio signal into a digital signal and interleaves the digital signal and transmits the interleaved digital signal, and a receiver de-interleaves the received interleaved digital signal so as to obtain the original audio signal. It is difficult to see through the fifth scrambler system, however, there are disadvantages in that the circuit construction is complex and the transmission must be performed digitally.

Hence, there is a demand for a scrambler system which has a large number of keys so that it is difficult to guess and see through the scrambler system, but has a simple circuit construction.

SUMMARY OF THE INVENTION

Accordingly, it is a general object of the present invention to provide a novel and useful scrambler system in which the disadvantages described heretofore are eliminated.

Another and more specific object of the present invention is to provide a scrambler system comprising a first oscillator circuit for generating a first local oscillation signal, a first frequency dividing circuit for obtaining a first frequency divided signal by frequency-dividing the first local oscillation signal by 1/N, a first triangular wave signal generating circuit for converting the first frequency divided signal into a first triangular wave signal and for controlling the oscillation frequency of the first oscillator circuit by the first triangular wave signal, a first multiplying circuit for obtaining a frequency converted audio signal by multiplying the first local osciallation signal with an input audio signal which is to be scrambled, a pilot signal generating circuit for generating from the first frequency divided signal a pilot signal having a single frequency, a first adding circuit for obtaining a scrambled signal by adding the pilot signal and the frequency converted audio signal, a first separating circuit for separating the pilot signal from the scrambled signal which is obtained through a transmission path, a second triangular wave signal generating circuit for generating from the separating pilot signal a second triangular wave signal, a second oscillator circuit for generating a second local oscillation signal, a second frequency dividing circuit for obtaining a second frequency divided signal by frequency-dividing the second local oscillation signal by 1/N, a phase comparing circuit for comparing the phase of the second frequency divided signal and the phase of the separated pilot signal from the first separating circuit and for generating a phase error signal, a second adding circuit for adding the phase error signal and the second triangular wave signal and for generating an added signal for controlling the oscillation frequency of the second oscillator circuit, a second separating circuit for separating the frequency converted audio signal from the scrambled signal which is obtained through the transmission path, and a second multiplying circuit for obtaining the original input audio signal by multiplying the second local oscillation signal with the separated frequency converted audio signal. According to the scrambler system of the present invention, the frequency of the scrambled signal changes on the time base, but the frequency of the pilot signal within the scrambled signal is constant. Hence, it is extremely difficult to see through the scrambler system. As keys for enabling de-scrambling of the scrambled signal, it is possible to use the coincidence of the frequency dividing ratios 1/N of the first and second frequency dividing circuits, and the coincidence of the levels of the first and second triangular wave signals, for example. Accordingly, the circuit construction of the scrambler system is relatively simple, but it is possible to provide a large number of keys for the scrambler system.

Other objects and further features of the present invention will be apparent from the following detailed description when read in conjunction with the accompanying drawings.

DETAILED DESCRIPTION

Figure 1:
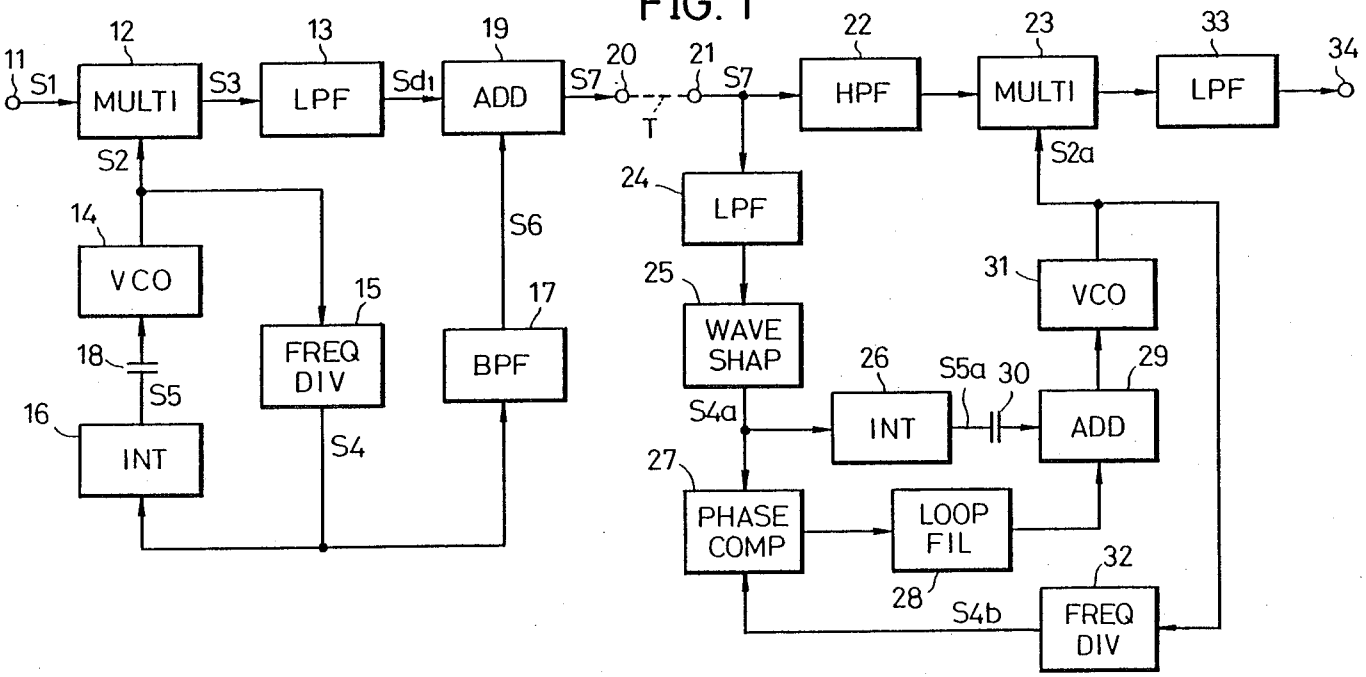
FIG. 1 is a system block diagram showing a first embodiment of the scrambler system according to the present invention.
Figure 2:
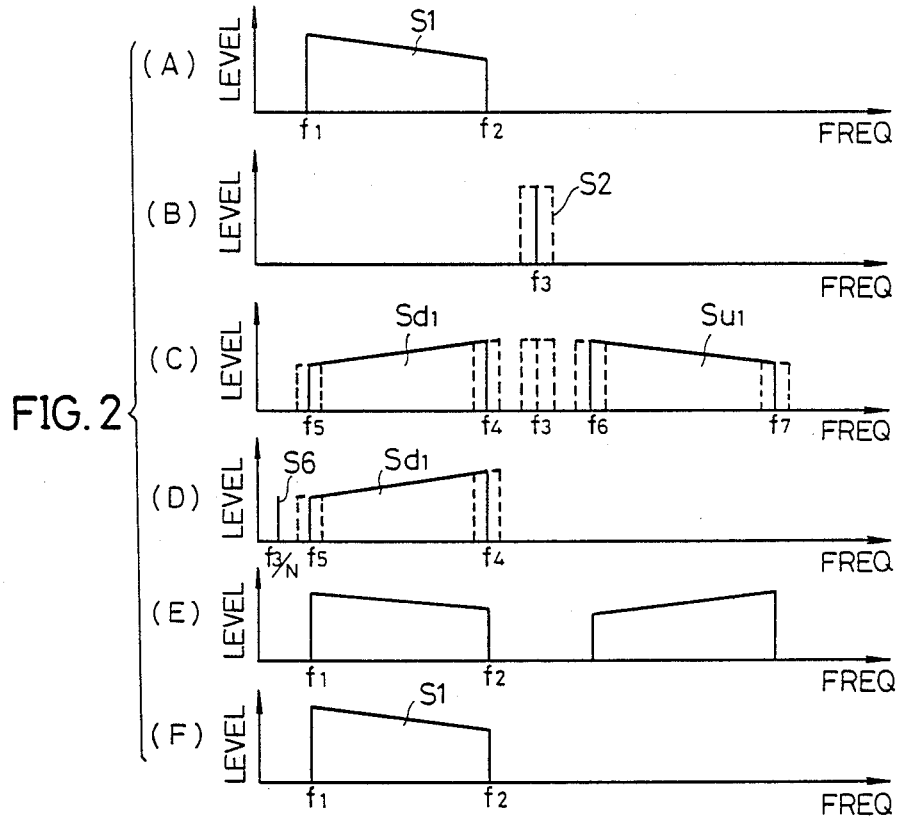
FIGS. 2(A) through 2(F) show frequency spectrums of signals at parts of the block system shown in FIG. 1.
Figure 3:
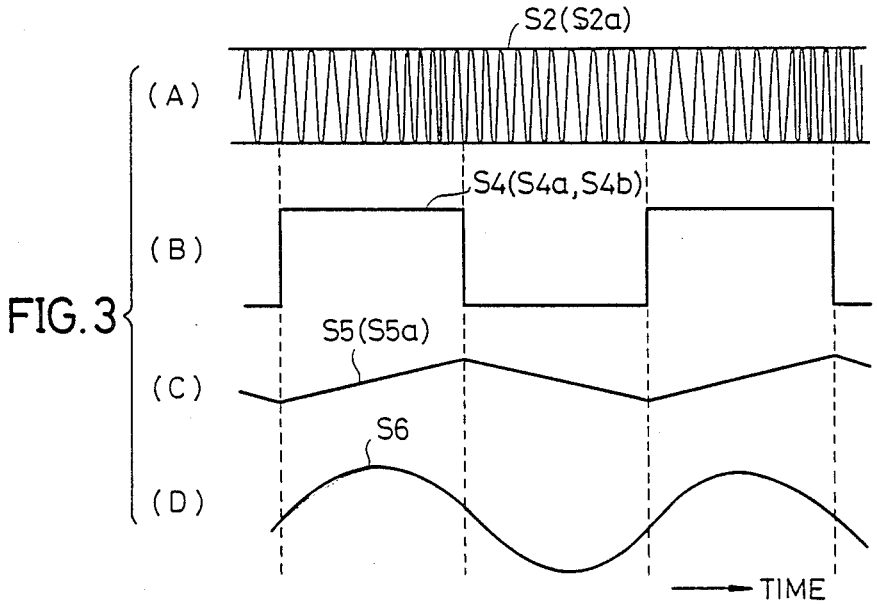
FIGS. 3(A) through 3(D) show waveforms of signals at parts of the block system shown in FIG. 1.

FIG. 1 shows the first embodiment of the scrambler system according to the present invention. An audio signal S1 which is to be scrambled is supplied to a multiplier 12 through an input terminal 11. The audio signal S1 exists within a frequency band having a lower limit frequency f1 and an upper limit frequency f2 as shown in FIG. 2(A). For example, the frequencies f1 and f2 are respectively equal to 300 Hz and 3 kHz. A local oscillation signal (carrier) S2 having a variable frequency band as shown in FIG. 2(B) and having a waveform shown in FIG. 3(A) is supplied to the multiplier 12 from a voltage controlled oscillator (VCO) 14. A center frequency f3 of the signal S2 is selected to a frequency greater than the frequency f2, and the frequency f3 is equal to 3.3 kHz, for example. The multiplier 12 multiplies the signal S1 with the signal S2 and generates a signal S3 having a frequency spectrum shown in FIG. 2(C). In other words, the multiplier 12 generates a frequency converted audio signal.

The output signal S3 of the multiplier 12 comprises a signal component Sd1 of the difference frequencies and existing in a frequency range from a frequency f4 and to a frequency f5, and a signal component Su1 of the sum frequencies and existing in a frequency range from a frequency f6 to a frequency f7. The frequencies f1 through f7 satisfy the following relationships which are $f4=f3-f1$, $f5=f3-f2$, $f6=f3+f1$, and $f7=f3+f2$. The output signal S3 of the multiplier 12 is supplied to a lowpass filter 13 which only passes the signal component Sd1, and the output signal Sd1 of the lowpass filter 13 is supplied to an adder 19.

On the other hand, the output signal S2 of the VCO 14 is frequency-divided by 1/N in a frequency divider 15, and an output signal S4 of the frequency divider 15 is supplied to a Miller integrating circuit 16 and a bandpass filter 17. The value of N is selected to such a value that f3/N is smaller than the frequency f5. The frequency divider 15 constitutes a loop together with the Miller integrating circuit 16, a capacitor 18, and the VCO 14. Hence, a square wave signal S4 having a duty cycle of 50% as shown in FIG. 3(B) is obtained from the frequency divider 15, and a triangular wave signal S5 shown in FIG. 3(C) is obtained from the Miller integrating circuit 16. The triangular signal S5 is supplied to the VCO 14 through the capacitor 18, and thus, the oscillation frequency of the VCO 14 changes responsive to the triangular wave signal S5.

The bandpass filter 17 only passes a fundamental wave component of the square wave signal S4 which is obtained from the frequency divider 15. As a result, a pilot signal S6 shown in FIG. 3(D) which corresponds to the fundamental wave component of the square wave signal S4 is obtained from the bandpass filter 17. As shown in FIG. 3(D), the pilot signal S6 is a sinusoidal wave having a constant frequency f3/N. The pilot signal S6 is supplied to the adder 19. The adder 19 adds the signal component Sd1 and the pilot signal S6 and obtains an added signal S7. This added signal S7 is supplied to an output terminal 20 on the transmission side as a scrambled signal S7. The scrambled signal S7 from the output terminal 20 is transmitted through a suitable transmission path T and is supplied to an input terminal 21 on the receiver side. For example, the scrambled signal S7 has a frequency spectrum shown in FIG. 2(D).

The scrambled signal S7 from the input terminal 21 is supplied to a highpass filter 22 and lowpass filter 24. The highpass filter 22 only passes a signal component existing in the high frequency part of the scrambled signal S7, that is, only passes the signal component Sd1 in the frequency spectrum shown in FIG. 2(D). The signal component Sd1 from the highpass filter 22 is supplied to a multiplier 23. The lowpass filter 24 only passes a signal component existing in the low frequency part of the scrambled signal S7, that is, only passes the pilot signal S6 in the frequency spectrum shown in FIG. 2(D). The pilot signal S6 from the lowpass filter 24 is supplied to a wave shaping circuit 25. The wave shaping circuit 25 shapes the pilot signal S6 into a square wave signal S4*a* having a waveform similar to that shown in FIG. 3(B), and supplies the square wave signal S4*a* to a Miller integrating circuit 26 and a phase comparator 27. The Miller integrating circuit 26 integrates the square wave signal S4*a* into a triangular wave signal S5*a* having a waveform similar to that shown in FIG. 3(C), and supplies the triangular wave signal S5*a* to an adder 29 through a capacitor 30.

On the other hand, the phase comparator 27 is also supplied with a square wave signal S4*b* having a waveform similar to that shown in FIG. 3(B). This square wave signal S4*b* is obtained from a frequency divider 32 by frequency-dividing by 1/N an output signal S2*a* of a VCO 31 having a waveform similar to that shown in FIG. 3(A). Accordingly, the phase comparator 27 compares the phases of the signals S4*a* and S4*b* and supplies a phase error signal to a loop filter 28. The loop filter 28 converts the phase error signal into an error voltage and supplies the error voltage to the adder 29.

The VCO 31, the frequency divider 32, the phase comparator 27, the loop filter 28, and the adder 29 constitute a phase locked loop. Hence, the output error voltage of the loop filter 28 supplied to the VCO 31 through the adder 29 must have a polarity suited for the phase locked loop operation. A signal which is supplied from the adder 29 to the VCO 31 is identical to the triangular wave signal S5 shown in FIG. 3(C) which is supplied to the VCO 14 for controlling the oscillation frequency thereof. Accordingly, the signal S2*a* which is generated from the VCO 31 and is supplied to the multiplier 23 as a local oscillation signal (carrier) is identical to the signal S2 shown in FIG. 3(A) which is generated from the VCO 14. The multiplier 23 multiplies the output signal component Sd1 of the highpass filter 22 with the output signal S2*a* of the VCO 31 and obtains a signal having a frequency spectrum shown in FIG. 2(E). This output signal of the multiplier 23 is supplied to a lowpass filter 33. The lowpass filter 33 passes the signal in a frequency range from the frequency f1 to the frequency f2 in FIG. 2(E) and supplies the passed signal to an output terminal 34. The signal obtained from the lowpass filter 33 has a frequency spectrum shown in FIG. 2(F). As may be seen by comparing FIGS. 2(A) and 2(F), the output signal of the lowpass filter 33 is identical to the audio signal S1 which was scrambled.

In the present embodiment, the frequency of the scrambled signal changes on the time base, but the frequency of the pilot signal within the scrambled signal is constant. Hence, it is extremely difficult to see through the scrambler system, that is, it is extremely difficult to guess the key of the scrambler system. As keys for enabling de-scrambling of the scrambled signal, it is possible to use the coincidence of the frequency dividing ratios 1/N of the frequency dividers 15 and 32, and the coincidence of the levels of the triangular wave signals obtained from the respective Miller integrating circuits 16 and 26, for example. Accordingly, the circuit construction of the scrambler system is relatively simple, but it is possible to provide a large number of keys for the scrambler system.

Figure 4:
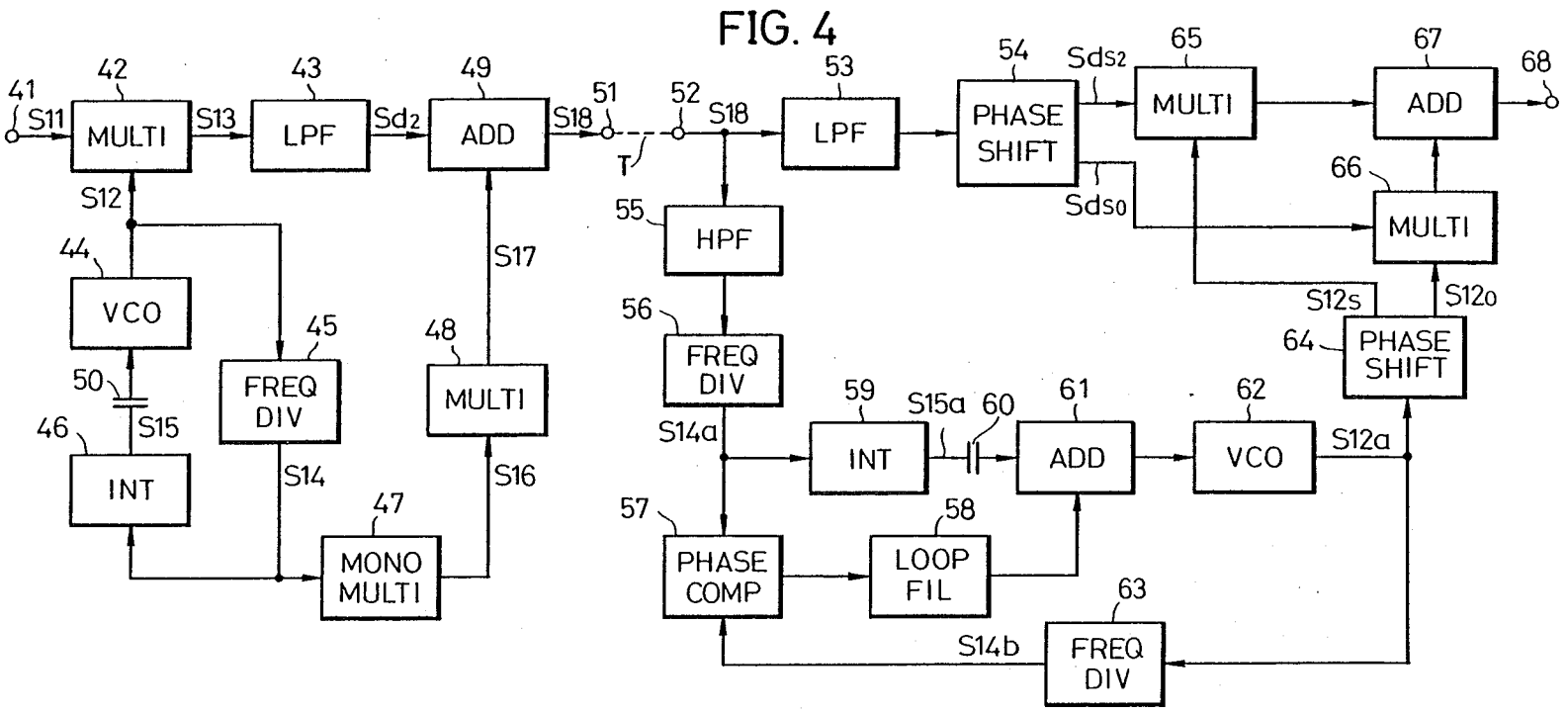
FIG. 4 is a system block diagram showing a second embodiment of the scrambler system according to the present invention.
Figure 5:
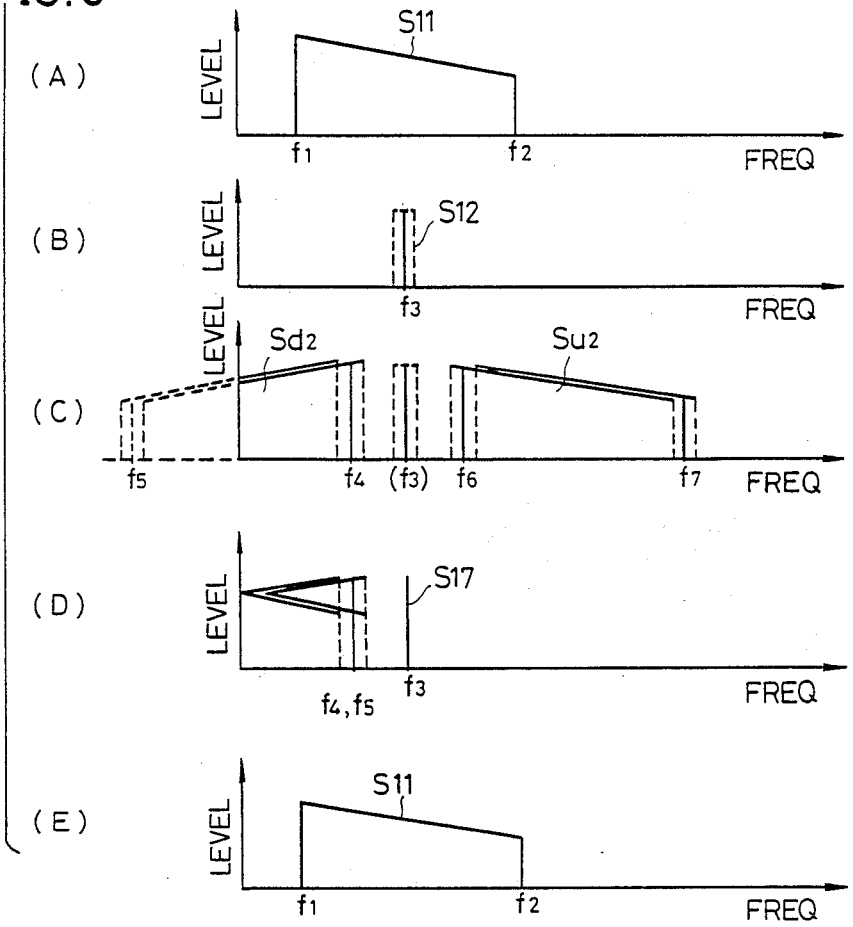
FIGS. 5(A) through 5(E) show frequency spectrums of signals at parts of the block system shown in FIG. 4.
Figure 6:
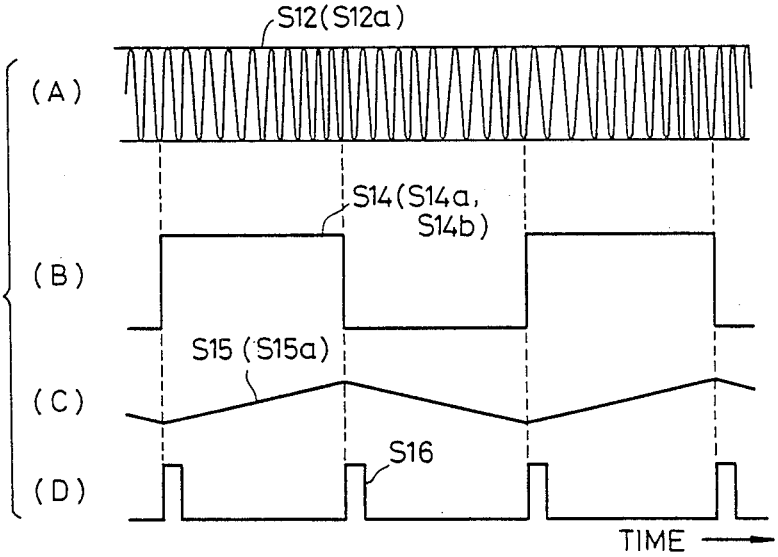
FIGS. 6(A) through 6(D) show waveforms of signals at parts of the block system shown in FIG. 4.

Next, description will be given with respect to a second embodiment of the scrambler system according to the present invention. FIG. 4 shows the second embodiment of the scrambler system according to the present invention. An audio signal S11 which is to be scrambled is identical to the audio signal S1 of the first embodiment described before and has a frequency spectrum shown in FIG. 5(A). The audio signal S11 is supplied to a multiplier 42 through an input terminal 41. A local oscillation signal (carrier) S12 having a variable frequency band as shown in FIG. 5(B) and having a waveform shown in FIG. 6(A) is supplied to the multiplier 42 from a voltage controlled oscillator (VCO) 44. A center frequency f3 of the signal S12 is selected to (f1+f2)/2, and the frequency f3 is equal to 1.65 kHz, for example. The multiplier 42 multiplies the signal S11 with the signal S12 and generates a signal S13 having a frequency spectrum shown in FIG. 5(C). In other words, the multiplier 42 generates a frequency converted audio signal.

The output signal S13 of the multiplier 42 comprises a signal component Sd2 of the difference frequencies and existing in a frequency range from a frequency f4 and to a frequency f5, and a signal component Su2 of the sum frequencies and existing in a frequency range from a frequency f6 to a frequency f7. However, the signal component Sd2 has a folded-back alias component as may be seen from FIGS. 5(C) and 5(D). The output signal S13 of the multiplier 42 is supplied to a lowpass filter 43 which only passes the signal component Sd2, and the output signal Sd2 of the lowpass filter 43 is supplied to an adder 49.

On the other hand, the output signal S12 of the VCO 44 is frequency-divided by 1/N in a frequency divider 45, and an output signal S14 of the frequency divider 45 is supplied to a Miller integrating circuit 46 and a monostable multivibrator 47. For example, the value of N is selected to $2^n$, where n is an integer. The frequency divider 45 constitutes a loop together with the Miller integrating circuit 46, a capacitor 50, and the VCO 44. Hence, a square wave signal S14 having a duty cycle of 50% as shown in FIG. 6(B) is obtained from the frequency divider 45, and a triangular wave signal S15 shown in FIG. 6(C) is obtained from the Miller integrating circuit 46. The triangular signal S15 is supplied to the VCO 44 through the capacitor 50, and thus, the oscillation frequency of the VCO 44 changes responsive to the triangular wave signal S15.

The monostable multivibrator 47 which is supplied with the output square wave signal S14 of the frequency divider 45 generates a signal S16 shown in FIG. 6(D) having such a waveform that even-number order harmonics will not be generated. The signal S16 is supplied to a multiplier 48 which generates a pilot signal S17. The pilot signal S17 is a sinusoidal wave having a constant frequency f3, and this pilot signal is supplied to the adder 49. The adder 49 adds the signal component Sd2 and the pilot signal S17 and obtains an added signal S18. This added signal S18 is supplied to an output terminal 51 on the transmission side as a scrambled signal S18. The scrambled signal S18 from the output terminal 51 is transmitted through a suitable transmission path T and is supplied to an input terminal 52 on the receiver side. For example, the scrambled signal S18 has a frequency spectrum shown in FIG. 5(D).

The scrambled signal S18 from the input terminal 52 is supplied to a lowpass filter 53 and a highpass filter 55. The lowpass filter 53 only passes a signal component existing in the low frequency part of the scrambled signal S18, that is, only passes the signal component Sd2 in the frequency spectrum shown in FIG. 5(D). The highpass filter 55 only passes a signal component existing in the high frequency part of the scrambled signal S18, that is, only passes the pilot signal S17 in the frequency spectrum shown in FIG. 5(D). The pilot signal S17 from the highpass filter 55 is supplied to a frequency divider 56. The frequency divider 56 frequency-divides the pilot signal S17 by 1/N and generates a square wave signal S14*a* having a waveform similar to that shown in FIG. 6(B). This square wave signal S14*a* is supplied to a Miller integrating circuit 59 and a phase comparator 57.

The Miller integrating circuit 59 integrates the signal S14*a* and generates a triangular wave signal S15*a* having a waveform similar to that shown in FIG. 6(C). This triangular wave signal S15*a* is supplied to an adder 61 through a capacitor 60. On the other hand, the phase comparator 57 is also supplied with an output square wave signal S14*b* of a frequency divider 63 having a waveform similar to that shown in FIG. 6(B). The square wave signal S14*b* is obtained by frequency-dividing by 1/N an output signal S12*a* of a VCO 62 having a waveform similar to that shown in FIG. 6(A). Accordingly, the phase comparator 57 compares the phases of the signals S14*a* and S14*b* and supplies a phase error signal to a loop filter 58. The loop filter 58 converts the phase error signal into an error voltage, and supplies the error voltage to the adder 61.

The VCO 62, the frequency divider 63, the phase comparator 57, the loop filter 58, and the adder 61 constitute a phase locked loop. Hence, the output voltage of the loop filter 58 supplied to the VCO 62 through the adder 61 must have a polarity suited for the phase locked loop operation. A signal which is supplied from the adder 61 to the VCO 62 is identical to the triangular wave signal S15 shown in FIG. 6(C) which is supplied to the VCO 44 for controlling the oscillation frequency thereof. Accordingly, the signal S12*a* which is generated from the VCO 62 as a local oscillation signal (carrier) is identical to the signal S12 shown in FIG. 6(A) which is generated from the VCO 44.

The output signal S12*a* of the VCO 62 is supplied to a phase shift circuit 64. The phase shift circuit 64 generates based on the signal S12*a* a local oscillation signal S12*s* having a reference phase and a local oscillation signal S12*o* having a 90° phase difference with respect to the signal S12*s*. The signal S12*s* is supplied to a multiplier 65, and the signal S12*o* is supplied to a multiplier 66. On the other hand, a phase shift circuit 54 is supplied with the output signal component Sd2 of the lowpass filter 53. The phase shifting circuit 54 generates based on the signal component Sd2 a signal Sd2*s* having a reference phase and a signal Sd2*s* and a signal Sd2*o* having a 90° phase difference with respect to the signal Sd2*s*. The signal Sd2*s* is supplied to the multiplier 65, and the signal Sd2*o* is supplied to the multiplier 66.

Accordingly, the multiplier 65 multiplies the signals Sd2*s* and S12*s* and supplies a multiplied signal to an adder 67. The multiplier 66 multiplies the signals Sd2*o* and S12*o* and supplies a multiplied signal to the adder 67. The adder 67 generates a signal having a frequency spectrum shown in FIG. 5(E) and supplies this signal to an output terminal 68. As may be seen by comparing FIGS. 5(A) and 5(E), the signal obtained from the adder 67 is identical to the audio signal S11 which was scrambled.

It is possible to set a multiplying coefficient of the multiplier 48 to kN, where k is greater than or equal to two. In this case, the frequency dividing ratio of the frequency divider 56 should be set to 1/kN.

In the present embodiment, it is possible to obtain the same effects as those obtained in the first embodiment described before. Further, since the signal component Sd2 has the folded-back alias component, it is even more difficult to see through the scrambler system, that is, it is extremely difficult to guess the key of the scrambler system. The scrambled signal will only be reproduced as noise when the signal is intercepted in the transmission path T. Moreover, because the scrambled audio signal is shifted in the low frequency range, the high frequency part of the transmission band can be used for the transmission of other signals. As keys for enabling de-scrambling of the scrambled signal, it is possible to use in addition to those described before in conjunction with the first embodiment the coincidence of an inverse number of the multiplying coefficient N (or kN) of the multiplier 48 and the frequency dividing ratio 1/N (or 1/kN) of the frequency divider 56, and combinations thereof.

In the present embodiment, when the scrambled signal is transmitted in the form of a frequency modulated (FM) wave, it is possible to easily narrow the transmission band. As a result, it is possible to effectively utilize the channel used for the transmission and improve the signal-to-noise ratio.

Further, the present invention is not limited to these embodiments, but various variations and modifications may be made without departing from the scope of the present invention.

What is claimed is:

1. A scrambler system comprising:

an input terminal applied with an input audio signal which is to be scrambled;

a first oscillator for generating a first local oscillation signal;

first frequency dividing means for obtaining a first frequency divided signal by frequency-dividing said first local oscillation signal by 1/N;

first triangular wave signal generating means for converting said first frequency divided signal into a first triangular wave signal, said first triangular wave signal being supplied unmodified to said first oscillator and controlling an oscillation frequency thereof;

first multiplying means for obtaining a frequency converted audio signal by multiplying said first local oscillation signal with said input audio signal;

pilot signal generating means for generating from said first frequency divided signal a pilot signal having a single frequency;

first adding means for obtaining a scrambled signal by adding said pilot signal and said frequency converted audio signal;

transmitting means for transmitting the scrambled signal through a predetermined transmission path so that the pilot signal coexists with the frequency converted audio signal on the predetermined transmission path;

receiving means for receiving the scrambled signal which is transmitted through the predetermined transmission path;

first separating means supplied with the scrambled signal from said receiving means for separating the pilot signal from the scrambled signal;

square wave signal generating means for generating from the output separated pilot signal of said first separating means a square wave signal having approximately the same waveform as said first frequency divided signal;

second triangular wave signal generating means for generating from said square wave signal a second triangular wave signal;

a second oscillator for generating a second local oscillation signal which is approximately the same as said first local oscillation signal;

second frequency dividing means for obtaining a second frequency divided signal by frequency-dividing said second local oscillation signal by 1/N;

phase comparing means for comparing phases of said second frequency divided signal and said square wave signal and for generating a phase error signal;

second adding means for obtaining an added signal by adding said phase error signal and said second triangular wave signal, said added signal being supplied to said second oscillator and controlling an oscillation frequency thereof;

second separating means supplied with the scrambled signal from said receiving means for separating the frequency converted audio signal from the scrambled signal; and second multiplying means for obtaining the original input audio signal by multiplying said second local oscillation signal with the output separated frequency modulated audio signal of said second separating means.

2. A scrambler system as claimed in claim 1 in which said input audio signal exists in a frequency band from a frequency f1 to a frequency f2, where f2 is greater than f1, said first local oscillation signal generated by said first oscillator has a center frequency f3 which is greater than f2, and said first multiplying means comprises a first multiplier and a first lowpass filter, and first multiplier generating the frequency converted audio signal comprising a signal component Sd1 of difference frequencies and existing in a frequency range from a frequency f4 and to a frequency f5 and a signal component Su1 of sum frequencies and existing in a frequency range from a frequency f6 to a frequency f7, and said first lowpass filter passes only said signal component Sd1 of the difference frequencies out of the frequency converted audio signal generated from said first multiplier, where $f4=f3-f1$, $f5=f3-f2$, $f6=f3+f1$, and $f7=f3+f2$.

3. A scrambler system as claimed in claim 2 in which said pilot signal generating means comprises a bandpass filter for generating a pilot signal having a frequency f3/N by passing only a fundamental wave component of said first frequency divided signal.

4. A scrambler system as claimed in claim 2 in which said first oscillator comprises a voltage controlled oscillator, and said first triangular wave signal generating means comprises a Miller integrating circuit.

5. A scrambler system as claimed in claim 2 in which said first separating means comprises a second lowpass filter, said second separating means comprises a highpass filter, and said second multiplying means comprises a second multiplier for multiplying an output frequency converted audio signal of said highpass filter with said second local oscillation signal and a third lowpass filter for passing out of an output signal of said second multiplier an audio signal which is in a low frequency range and is identical to said input audio signal.

6. A scrambler system as claimed in claim 5 in which said phase comparing means comprises a phase comparator for generating an error signal by comparing phases of said square wave signal and said second frequency divided signal and a loop filter for converting the output error signal of said phase comparator into said phase error signal.

7. A scrambler system as claimed in claim 5 in which said second oscillator comprises a voltage controlled oscillator, and said second triangular wave signal generating means comprises a Miller integrating circuit.

8. A scrambler system as claimed in claim 2 in which a key for de-scrambling said scrambled signal is a coincidence of frequency dividing ratios 1/N of said first and second frequency dividing means.

9. A scrambler system as claimed in claim 2 in which a key for de-scrambling said scrambled signal is a coincidence of levels of said first and second triangular wave signals.

10. A scrambler system as claimed in claim 2 in which N has such a value that f3/N is smaller than f5.

11. A scrambler system as claimed in claim 1 in which said input audio signal exists in a frequency band from a frequency f1 to a frequency f2, where f2 is greater than f1, said first local oscillation signal generated by said first oscillator has a center frequency f3 which is equal to $(f1+f2)/2$, and said first multiplying means comprises a first multiplier and a first lowpass filter, said first multiplier generating the frequency converted audio signal comprising a signal component Sd2 of difference frequencies and existing in a frequency range from a frequency f4 and to a frequency f5 and a signal component Su2 of sum frequencies and existing in a frequency range from a frequency f6 to a frequency f7, and said first lowpass filter passes only said signal component Sd2 of the difference frequencies out of the frequency converted audio signal generated from said first multiplier, where $f4=f3-f1$, $f5=f3-f2$, $f6=f3+f1$, and $f7=f3+f2$.

12. A scrambler system as claimed in claim 11 in which said pilot signal generating means comprises a monostable multivibrator supplied with said first frequency divided signal and a multiplying circuit for generating a pilot signal having a frequency kf3 by multiplying kN to an output signal of said monostable multivibrator, where k is an integer greater than or equal to one.

13. A scrambler system as claimed in claim 12 in which said square wave signal generating means comprises third frequency dividing means for generating said square wave signal by frequency-dividing the output separated pilot signal of said first separating means by 1/kN.

14. A scrambler system as claimed in claim 13 in which a key for de-scrambling said scrambled signal is a coincidence of an inverse number of multiplying coefficient kN of said multiplying circuit and a frequency dividing ratio 1/kN of said third frequency dividing means.

15. A scrambler system as claimed in claim 11 in which said first oscillator comprises a voltage controlled oscillator, and said first triangular wave signal generating means comprises a Miller integrating circuit.

16. A scrambler system as claimed in claim 11 in which said first separating means comprises a highpass filter, said second separating means comprises a second lowpass filter, and said second multiplying means comprises first phase shifting means supplied with the frequency converted audio signal from said second lowpass filter for generating a first frequency converted audio signal having a reference phase and a second frequency converted audio signal having a 90° phase difference with respect to said first frequency converted audio signal, second phase shifting means supplied with said second local oscillation signal for generating a third local oscillation signal having a reference phase and a fourth local oscillation signal having a 90° phase difference with respect to said third local oscillation signal, a second multiplier for multiplying said first frequency converted audio signal with said third local oscillation signal, a third multiplier for multiplying said second frequency converted audio signal with said fourth local oscillation signal, and third adding means for obtaining the original input audio signal by adding output signals of said second and third multipliers.

17. A scrambler system as claimed in claim 16 in which said phase comparing means comprises a phase comparator for generating an error signal by comparing phases of said square wave signal and said second frequency divided signal and a loop filter for converting the output error signal of said phase comparator into said phase error signal.

18. A scrambler system as claimed in claim 16 in which said second oscillator comprises a voltage controlled oscillator, and said second triangular wave signal generating means comprises a Miller integrating circuit.

19. A scrambler system as claimed in claim 11 in which N is equal to $2^n$, where n is an integer.

20. A scrambler system as claimed in claim 11 in which a key for de-scrambling said scrambled signal is a coincidence of frequency dividing ratios 1/N of said first and second frequency dividing means.

21. A scrambler system as claimed in claim 11 in which a key for de-scrambling said scrambled signal is a coincidence of levels of said first and second triangular wave signals.

* * * * *